US006679211B2

(12) United States Patent
Nickel

(10) Patent No.: US 6,679,211 B2
(45) Date of Patent: Jan. 20, 2004

(54) MANUALLY GUIDED IMPLEMENT

(75) Inventor: Hans Nickel, Cottenweiler (DE)

(73) Assignee: Andreas Stihl AG & Co. (DE)

( * ) Notice: Subject to any disclaimer, the term of this patent is extended or adjusted under 35 U.S.C. 154(b) by 92 days.

(21) Appl. No.: 10/104,517

(22) Filed: Mar. 22, 2002

(65) Prior Publication Data

US 2002/0134339 A1 Sep. 26, 2002

(30) Foreign Application Priority Data

Mar. 26, 2001 (DE) ..... 101 14 866

(51) Int. Cl.[7] ..... F02N 17/00
(52) U.S. Cl. ..... 123/179.14
(58) Field of Search ..... 123/179.14, 179.7, 123/179.9, 179.12, 514, 510; 261/35, DIG. 35, DIG. 36.2, DIG. 68

(56) References Cited

U.S. PATENT DOCUMENTS 3,265,050 A * 8/1966 Tuckey ..... 261/DIG. 68
4,462,346 A * 7/1984 Haman et al. ..... 123/179.9
4,824,613 A * 4/1989 Scott et al. ..... 261/35
5,241,931 A * 9/1993 Radel ..... 123/179.14
5,353,759 A * 10/1994 Abe et al. ..... 123/179.15

* cited by examiner

*Primary Examiner*—Henry C. Yuen
*Assistant Examiner*—Arnold Castro
(74) *Attorney, Agent, or Firm*—R W Becker & Associates; R W Becker

(57) ABSTRACT

A manually guided implement having an internal combustion engine, especially one embodied as a two-stroke engine, is provided, and also includes a crankcase and a carburetor. The implement has a fuel-conveying system for supplying fuel to the carburetor. Downstream of the carburetor, via a power line and a metering device disposed in the primer line, the fuel-conveying system is connected to an area that in the intake phase communicates with the crankcase. The metering device is controlled by the pressure in the crankcase.

13 Claims, 2 Drawing Sheets

MANUALLY GUIDED IMPLEMENT

BACKGROUND OF THE INVENTION

The present invention relates to a manually guided implement having an internal combustion engine, especially one embodied as a two-stroke engine.

To achieve a high output and to fulfill the applicable exhaust gas standards, manually guided implements having an internal combustion engine and a carburetor are provided with an appropriate setting of the fuel/air ratio, which is adapted to the hot-running condition of the internal combustion engine. When starting the internal combustion engine after it has been inoperative for a long period of time, and in particular under cold environmental conditions, the mixture provided by the carburetor is too lean and can lead to difficulties in starting the engine.

To improve the starting conditions, especially the cold-start conditions of the internal combustion engine, arrangements are known for enriching the mixture during the starting phase. For example, an increased underpressure can be produced in the intake channel of the carburetor via a starter valve that is disposed in the intake channel ahead of the butterfly valve. Due to the increased underpressure, an increased quantity of fuel is drawn in relative to the quantity of air that is drawn in by the internal combustion engine. The mixture becomes richer, thereby improving the starting conditions. However, a drawback of this arrangement is the increased cost of construction, especially with regard to the kinematic control of the starter valve.

It is also known, for enriching the fuel/air mixture, to provide a so-called primer pump, via which, prior to the start or during the starting process, a predetermined quantity of fuel can be injected into the intake line of the internal combustion engine via a primer line. As a result, a sufficient quantity of fuel is already available during the first rotation of the crankshaft during the starting process. To avoid difficulties during the metering of the fuel via a primer pump, embodiments are known according to which the pump is integrated into the carburetor. By means of a pressure line that is connected with the crankcase of the internal combustion engine, the primer pump is shut off when the internal combustion engine starts. Such a carburetor arrangement has a complex construction and is difficult to adjust with regard to the quantity of fuel that is to be injected.

It is therefore an object of the present invention to improve the starting characteristics of the internal combustion engine of a manually guided implement.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
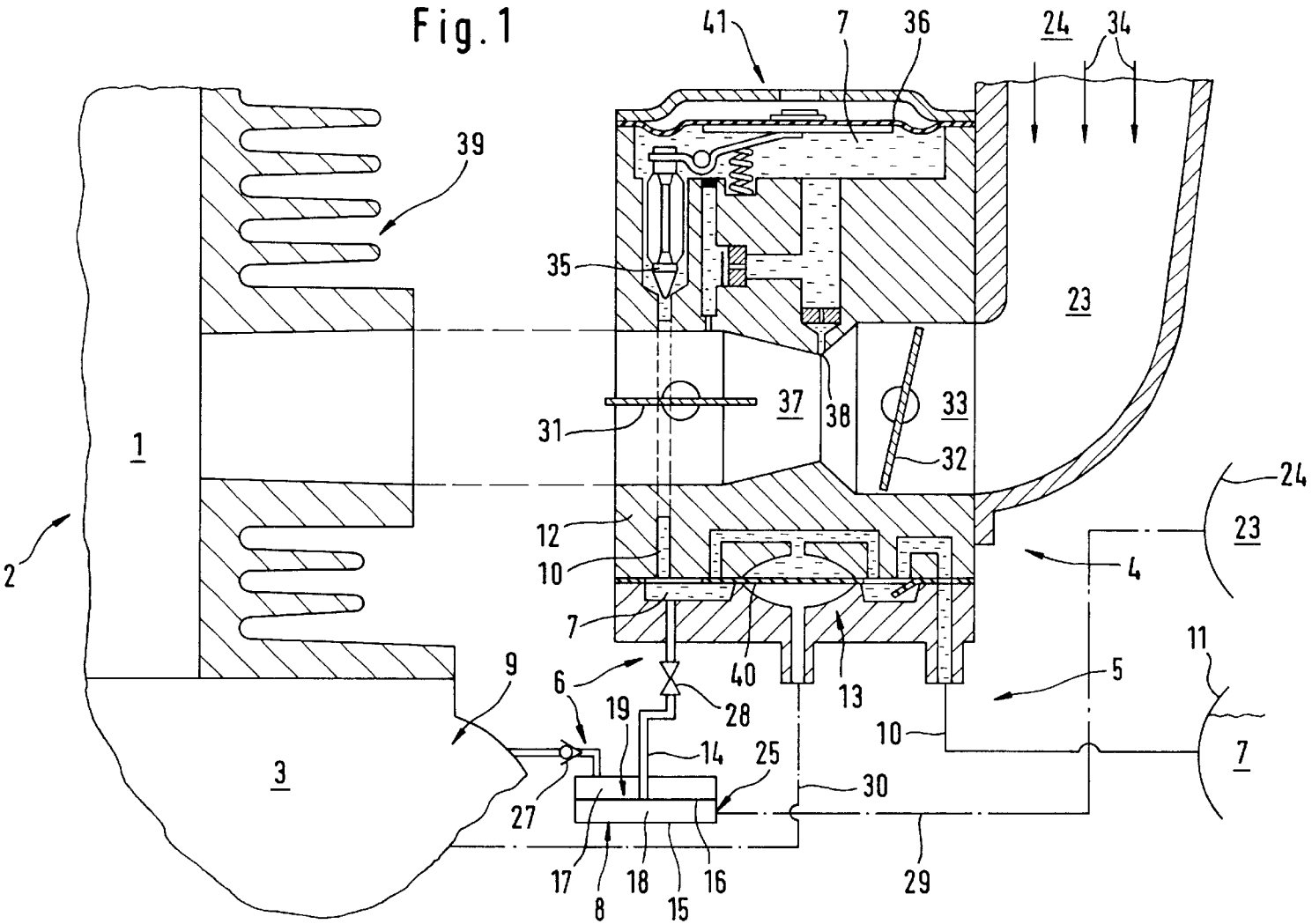
FIG. 1 is a cross-sectional view of one exemplary inventive arrangement of an internal combustion engine having a carburetor and a primer line.

It is proposed to provide the primer line with a metering device for fuel, via which the fuel-conveying system of the implement can be connected with the crankcase or with an area, such as a transfer channel, that communicates with the crankcase in the intake phase. The metering device can thereby be controlled by the pressure in the crankcase. With such an arrangement, the carburetor does not have to be modified, or at most has to be modified only slightly. By controlling the metering device via the pressure in the crankcase, the quantity of fuel that is to be injected prior to or during the starting process can be metered precisely, whereby as a consequence of the varying pressure distribution in the crankcase during starting of the internal combustion engine, the additional supply of fuel can be automatically reduced or stopped. By supplying the fuel directly into the crankcase or, for example, into a transfer channel, the fuel can be made available close to the combustion chamber, as a result of which undesired condensation effects on cold engine components, for example in the region of the intake channel close to the carburetor, are reduced.

Pursuant to an expedient further development, a fuel pump is disposed in the fuel line that leads from the fuel tank to the carburetor. By means of this fuel pump, the carburetor is supplied with an adequate quantity of fuel regardless of its position. In this connection, on the pressure side of the fuel pump the primer line is branched off from the fuel line. With such an embodiment, no further pump elements or the like are necessary for conveying the fuel through the primer line, so that the overall arrangement of the fuel enrichment can be kept very simple. In particular, for this purpose a diaphragm pump is provided in the housing of the carburetor, as a result of which the structural expenditure is limited to an appropriate branching off of the primer line.

Pursuant to one advantageous further development, the metering device is controlled by the pressure in that portion of the primer line that is disposed between the metering device and the crankcase. In particular when the metering device is embodied as a diaphragm control valve, the reciprocal effect between the valve control function and the oscillating pressure in the crankcase is thereby effected via only one line, so that an additional expenditure, for example for a control line, a mechanical drive, or the like can be eliminated. In this connection, the diaphragm valve is expediently provided with respective first and second chambers that are separated from one another by a diaphragm, whereby the first chamber forms a portion of the primer line. During or after the starting process, a valve element that can be closed off by the diaphragm takes care, as the need arises, for a supply or an interruption of additional fuel as a function of the control pressure that occurs in the crankcase and that is transferred by the primer line. The control via an elastic diaphragm is resistant to wear and has a straightforward construction. In this connection, the valve element is expediently in the form of a short cylindrical piece against the sealing rim of which the diaphragm rests. With this arrangement, a mechanical expenditure for pivotably or displaceably guided mechanical valve parts is avoided, and a reliable sealing function is ensured.

In conjunction with a check valve in the primer line between the crankcase and the metering device, fuel is conveyed into the first chamber of the diaphragm control valve via the fuel pump and the valve element. From there, fuel droplets are drawn in during the starting phase of the internal combustion engine by the underpressure in the crankcase. The subsequently rising underpressure in the crankcase effects a closing of the check valve, thereby avoiding a back pumping. After the internal combustion engine starts, the pressure in the crankcase drops during the intake phase in such a way that the diaphragm is pressed onto the sealing rim against the conveying pressure of the fuel pump. As a result, the fuel supply via the primer line is reliably prevented after the internal combustion engine starts; the internal combustion engine draws in a fuel/air mixture having a preset fuel/air ratio in a desired manner essentially exclusively via the carburetor.

The second chamber of the diaphragm control valve is expediently provided with an air supply opening via which the valve is connected in particular with the clean air side of an air filter that is disposed ahead of the carburetor. The diaphragm control valve thereby operates independent of the environmental pressure with regard to its setting. In this connection, the first and second chambers are expediently interconnected via a flow control device via which a pressure equalization can be effected between the two chambers at an only low underpressure in the crankcase and a correspondingly low intake volume stream through the primer line. With an appropriately set flow control device, a fuel supply can thereby also be effected via the primer line even after starting of the internal combustion engine at only low speed. This can be expedient in particular if the engine has already started, yet is not running smoothly. As the speed of the internal combustion engine increases, the appropriately set flow control device no longer effects an adequate pressure equalization between the two chambers, as a result of which the diaphragm closes the valve and terminates the primer process.

Pursuant to one expedient variation, the flow control device is adjustable. At appropriately cold environmental conditions, the cross-sectional area of the flow control device can be opened as wide as necessary, as a result of which even after the engine starts, at average speeds additional fuel flows through the primer line for enriching the mixture. Along with the metering device, the primer line assumes a function comparable to that of a starter valve. As a result, the carburetor can have a simple construction due to the elimination of a starter valve.

A shut off valve can be provided in the primer line upstream of the metering device. By actuating the shut off valve, it is possible even during a rough operation of the implement, where impact and vibrational stresses are encountered, to reliably prevent a supply of fuel via the primer line, which supply would not be desired during operation of the implement.

Further specific features of the present invention will be described in detail subsequently.

DESCRIPTION OF PREFERRED EMBODIMENTS

Referring now to the drawings in detail, illustrated in the schematic cross-sectional view of FIG. 1 is an internal combustion engine 2 in the form of a two-stroke engine 1. The internal combustion engine 2 can also be a mixture-lubricated four-stroke engine or the like. In the region of the cylinder 39, the internal combustion engine 2 is connected with a carburetor 4, whereby air is drawn in, in the direction of the arrows 34, by means of an intake channel 33 that leads through the carburetor 4. A fuel-conveying system 5 includes a fuel tank 11 that is filled with fuel 7 and that is connected with the carburetor 4 via a fuel line 10. A fuel pump 13, which is disposed in a housing 12 of the carburetor 4, is embodied as a diaphragm pump 40 and for its operation is connected via a pressure line 30 with a crankcase 3 of the internal combustion engine 2. By means of the pressure line 30, the diaphragm pump 40 is acted upon by an oscillating pressure in the crankcase 3. The fuel pump 13 can also be an electrical pump or the like.

The fuel 7 is conveyed to a fuel nozzle 38 via the diaphragm pump 40 and a control chamber 41 by means of a fuel valve 35 that is controlled by a diaphragm 36. The fuel nozzle 38 is disposed in a venturi section 37 of the intake channel 33. As a consequence of the venturi section 37, during intake of combustion air along the arrows 35 there results an underpressure, as a result of which fuel is drawn in through the fuel nozzle 38 and is combined with the air to form a fuel/air mixture.

Provided downstream of the fuel nozzle 38 is a butterfly valve 31 for controlling the flow volume and hence the power of the internal combustion engine 2. Disposed upstream of the fuel nozzle 38 and the venturi section 37 is a choke valve 32 by means of which the pressure in the venturi section 37 can be reduced further and hence the fuel/air mixture can be enriched for a cold start. In addition, upstream of the arrows 34 the carburetor 4 is connected to the clean air side 23 of an air filter 24 that is not shown in detail.

An area 9, which in the intake phase of the internal combustion engine 2 is in communication with the crankcase 3, is connected via a primer line 6 with the fuel-conveying system 5. In the illustrated embodiment, the area 9 is the crankcase 3 itself, and can also be a transfer channel or intake channel of the two-stroke engine 1 or an intake channel or crankcase of a mixture-lubricated four-stroke engine. On the pressure side of the diaphragm pump 40, the primer line 6 is branched off from the fuel line 10, and can also, for example, be supplied from a separate pump or can be connected directly with the fuel tank 11. Provided in the primer line 6 is a metering device 8 which in the illustrated embodiment is a diaphragm control valve 15. Depending upon the application, an embodiment as a mechanically, electrically, or magnetically controlled valve can also be expedient. A shut-off valve 28 is disposed in the primer line 6 upstream of the metering device 8. A check valve 27 is provided in a portion 14 of the primer line 6 between the crankcase 3 and the metering device 8.

The diaphragm valve 15 comprises respective first and second chambers 17,18, which are separated from one another by a diaphragm 16. In this connection, the first chamber 17 forms a portion 19 of the primer line 6. The second chamber 18 is provided with an air supply opening 25 to which is connected an air line 29. The second chamber 18 of the diaphragm control valve 15 is connected via the air line 29 with the clean air side 23 of the air filter 24 in a flow-conducting manner. With an appropriate configuration of the metering device 8, it would also be possible to eliminate the choke valve 32, as in the embodiment of FIG. 2.

Figure 2:
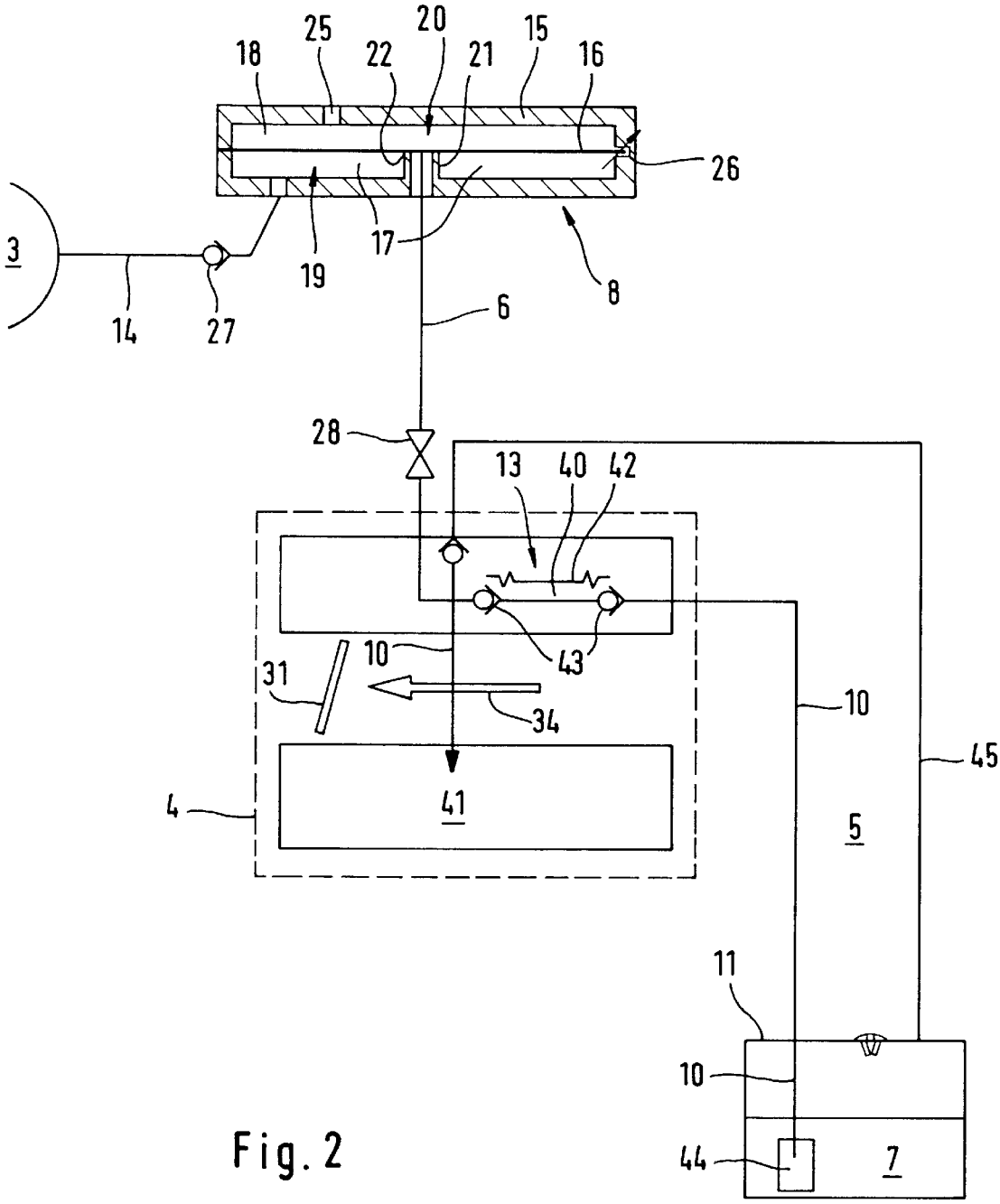
FIG. 2 is a schematic illustration of details of one variation of the arrangement of FIG. 1.

Details of the arrangement of FIG. 1 are schematically shown in FIG. 2, according to which the fuel pump 13, in the form of the diaphragm pump 40, comprises an arrangement of two check valves 43 and a diaphragm 42. By means of the diaphragm pump 40, fuel 7 is conveyed out of the fuel tank 11 to the control chamber 41 via a fuel filter 44 and the fuel line 10. A pressure equalization line 45, which branches off from the pressure side of the diaphragm pump 40, is provided for withdrawing fuel vapor from the fuel tank 11 and hence for the establishment of a pressure equalization in the fuel tank 11. On the pressure side of the fuel pump 13, the primer line 6 branches off from the fuel line 10 to the crankcase 3. Provided in the primer line 6 is the diaphragm control valve 15 with its two chambers 17,18. A shut-off valve 28 is disposed in the primer line 6 upstream of the diaphragm control valve 15.

The two chambers 17,18 are interconnected via an adjustable flow control device 26. Depending upon the application, the flow control device 26 can also have a fixed value. In the region of the first chamber 17, the diaphragm control valve 15 is provided, as a valve element 20, with a short cylindrical piece 21 that is in communication with the primer line 6 and against the circumferential sealing rim 22 of which the diaphragm 16 can come to rest in a sealing manner. It can also be expedient to embody the valve element 20 with a pivotable or linearly displaceable valve body.

A check valve 27 is provided in the portion 14 of the primer line 6 that is disposed between the diaphragm control valve 15 and the crankcase 3. In this arrangement, the diaphragm control valve 15 can be controlled by the pressure in the portion 14 in that during the intake phase of the internal combustion engine 2 (FIG. 1) fuel droplets are drawn in through the portion 14 from the first chamber 17. The underpressure that thereby results in the chamber 17 draws the diaphragm 16 against the sealing rim 22 and thereby closes off the valve element 20. By means of the flow control device 26, air filtered by the air filter 24 can flow out of the second chamber 18 and through the air supply opening 25 into the first chamber 17, as a result of which, at low speeds of the internal combustion engine 2 (FIG. 1), the fuel pump 13 can convey against the pressure of the diaphragm 16 on the sealing rim 22. At high speeds, the underpressure in the first chamber 17 generates a sufficiently high pressure of the diaphragm 16 on the sealing rim 22, whereby the underpressure in the first chamber 17 is no longer equalized by the flow control device 26 when the latter is appropriately set. Consequently, the valve element 20 is closed for normal operation.

The specification incorporates by reference the disclosure of German priority document DE 101 14 866.6 filed Mar. 26, 2001.

The present invention is, of course, in no way restricted to the specific disclosure of the specification and drawings, but also encompasses any modifications within the scope of the appended claims.

I claim:

1. A manually guided implement having an internal combustion engine, a crankcase and a carburetor comprising:

a fuel-conveying system for supplying fuel to said carburetor, wherein downstream of said carburetor, via a primer line and a metering device disposed in said primer line, said fuel-conveying system is connected to an area that in an intake phase communicates with said crankcase, and wherein said metering device is controlled via pressure in said crankcase.

2. An implement according to claim 1, wherein a shut-off valve is disposed in said primer line upstream of said metering device.

3. An implement according to claim 1, wherein a fuel line is provided that extends from a fuel tank to said carburetor, wherein a fuel pump is disposed in said fuel line, and wherein said primer line branches off from said fuel line on a pressure side of said fuel pump.

4. An implement according to claim 3, wherein said fuel pump is disposed in a housing of said carburetor.

5. An implement according to claim 1, wherein said metering device is controlled by pressure in a portion of said primer line disposed between said metering device and said crankcase.

6. An implement according to claim 5, wherein a check valve is disposed in said portion of said primer line that is disposed between said metering device and said crankcase.

7. An implement according to claim 1, wherein said metering device is a diaphragm control valve.

8. An implement according to claim 7, wherein said diaphragm control valve includes respective first and second chambers that are separated from one another by a diaphragm, and wherein said first chamber forms a portion of said primer line and includes a valve element that is closeable by means of said diaphragm.

9. An implement according to claim 8, wherein said valve element is a short cylindrical piece having a sealing rim for engagement against said diaphragm.

10. An implement according to claim 8, wherein said second chamber is provided with an air supply opening.

11. An implement according to claim 10, wherein said air supply opening is connected to a clean air side of an air filter for said carburetor.

12. An implement according to claim 8, wherein said first and second chambers are interconnected via a flow control device.

13. An implement according to claim 12, wherein said flow control device is adjustable.

* * * * *